US008723752B2

(12) United States Patent
Strydesky

(10) Patent No.: US 8,723,752 B2
(45) Date of Patent: May 13, 2014

(54) SEGMENTED ANTENNA REFLECTOR

(76) Inventor: Gregory L. Strydesky, Westfield, IN (US)

( * ) Notice: Subject to any disclaimer, the term of this patent is extended or adjusted under 35 U.S.C. 154(b) by 487 days.

(21) Appl. No.: 12/814,909

(22) Filed: Jun. 14, 2010

(65) Prior Publication Data

US 2010/0315306 A1 Dec. 16, 2010

Related U.S. Application Data

(60) Provisional application No. 61/186,615, filed on Jun. 12, 2009, provisional application No. 61/218,678, filed on Jun. 19, 2009.

(51) Int. Cl.
*H01Q 19/12* (2006.01)

(52) U.S. Cl.
USPC ..... 343/840; 343/915

(58) Field of Classification Search
USPC ..... 343/912, 915, 840
See application file for complete search history.

(56) References Cited

U.S. PATENT DOCUMENTS 3,176,303 A * 3/1965 Holland ..... 343/915
4,458,251 A 7/1984 Bondon
4,893,132 A 1/1990 Habibi
7,324,057 B2 * 1/2008 Argaman et al. ..... 343/779
7,859,479 B2 * 12/2010 Legare et al. ..... 343/882
7,965,256 B2 * 6/2011 Haight ..... 343/915
2006/0007050 A1 1/2006 Thrash et al.
2007/0052612 A1 3/2007 Trajkovic et al.
2008/0055185 A1 3/2008 Hogsett
2008/0111758 A1 5/2008 Griffiths

FOREIGN PATENT DOCUMENTS

JP 01-252004 A 1/1989

OTHER PUBLICATIONS

Search Report and Written Opinion issued in PCT/US2010/038354, dated Jan. 13, 2011.

* cited by examiner

*Primary Examiner* — James H Cho
(74) *Attorney, Agent, or Firm* — Ice Miller LLP

(57) ABSTRACT

In certain embodiments, a segmented reflector and an antenna having a segmented reflector are disclosed. In certain embodiments, the segments of the reflector are held in side-by-side relationship by the antenna transceiver. In certain other embodiments, the segments of the reflector are held in side-by-side relationship by magnets in each of the segments that are attracted to magnets in adjacent segments. In some embodiments, interengaging male and female detents are provided in the segment endwalls in order to resist shear forces once the segmented reflector is assembled. Other embodiments are also disclosed.

16 Claims, 22 Drawing Sheets

SECTION B-B

SECTION A-A

SEGMENTED ANTENNA REFLECTOR

CROSS-REFERENCE TO RELATED APPLICATIONS

The present application claims the benefit of U.S. Provisional Patent Application No. 61/186,615, which was filed Jun. 12, 2009. The present application also claims the benefit of U.S. Provisional Application No. 61/218,678, filed Jun. 19, 2009. Both of these applications are incorporated herein by reference in their entireties.

TECHNICAL FIELD OF THE DISCLOSURE

The present disclosure relates to antennas and, more particularly, to a segmented antenna reflector.

BACKGROUND OF THE DISCLOSURE

The present disclosure relates to segmented antenna reflectors and the antennas that utilize such reflectors. The illustrated embodiments utilize a parabolic reflector for exemplary illustration only, it being recognized that the principles of the present disclosure are applicable to antenna reflectors of any shape and dimension. For example, reflectors in the shape of other conic sections, off-center reflectors, flat reflectors and Cassegrain reflectors may also be used with the principles of the present disclosure, to give just a few non-limiting examples.

The use of parabolic antenna reflectors for both reception and transmission of electromagnetic signals is well known. It is also known that such parabolic antenna reflectors may be constructed in segments and then assembled into the full parabolic shape. The use of such a segmented design allows the antenna to assume a more compact shape when being shipped or otherwise transported. By way of non-limiting example, military personnel often carry segmented parabolic antennas in the field. When broken down, a fairly sizable antenna can be carried by a military vehicle or by an individual soldier (for example in a backpack) and then assembled in the field when there is a need to communicate. It will be appreciated that speed of assembling and breaking down the antenna in such situations is of concern. The present disclosure addresses these concerns.

SUMMARY OF THE DISCLOSURE

In certain embodiments, a segmented reflector and an antenna having a segmented reflector are disclosed. In certain embodiments, the segments of the reflector are held in side-by-side relationship by the antenna transceiver. In certain other embodiments, the segments of the reflector are held in side-by-side relationship by magnets in each of the segments that are attracted to magnets in adjacent segments. In some embodiments, interengaging male and female detents are provided in the segment endwalls in order to resist shear forces once the segmented reflector is assembled. Other embodiments are also disclosed.

In one embodiment, an antenna is disclosed, comprising a plurality of dish segments, wherein placing said plurality of dish segments in a side-by-side arrangement forms an antenna reflector, and a transceiver assembly, wherein said transceiver is operative to hold said plurality of dish segments in said side-by-side arrangement.

In another embodiment, an antenna is disclosed, comprising a plurality of dish segments, each of said plurality of dish segments comprising: a first endwall, a second endwall, at least one first magnet disposed on said first endwall, and at least one second magnet disposed on said second endwall, wherein placing said plurality of dish segments in a side-by-side arrangement forms an antenna reflector, such that each one of said plurality of first magnets is positioned adjacent a respective one of said plurality of second magnets, thereby forming a plurality of magnet pairs, and wherein attraction between each first magnet and second magnet pair is operative to hold said plurality of dish segments in said side-by-side arrangement.

In yet another embodiment, an antenna is disclosed, comprising a plurality of dish segments, each of said plurality of dish segments comprising: a first endwall, a second endwall, at least one first detent disposed on said first endwall, and at least one second detent disposed on said second endwall, wherein placing said plurality of dish segments in a side-by-side arrangement forms an antenna reflector, such that each one of said plurality of first detents is positioned adjacent a respective one of said plurality of second detents, thereby forming a plurality of detent pairs, and wherein interaction between each first detent and second detent pair is operative to resist shear forces between said plurality of dish segments.

In still another embodiment, an antenna is disclosed, comprising a plurality of dish segments, each of said plurality of dish segments comprising: a first endwall, a second endwall, at least one first magnet disposed on said first endwall, at least one second magnet disposed on said second endwall, at least one first detent disposed on said first endwall, and at least one second detent disposed on said second endwall, wherein placing said plurality of dish segments in a side-by-side arrangement forms an antenna reflector, such that each one of said plurality of first detents is positioned adjacent a respective one of said plurality of second detents, thereby forming a plurality of detent pairs, and each one of said plurality of first magnets is positioned adjacent a respective one of said plurality of second magnets, thereby forming a plurality of magnet pairs, and wherein attraction between each first magnet and second magnet pair is operative to hold said plurality of dish segments in said side-by-side arrangement, and wherein interaction between each first detent and second detent pair is operative to resist shear forces between said plurality of dish segments.

DETAILED DESCRIPTION OF THE DRAWINGS

Figure 1:
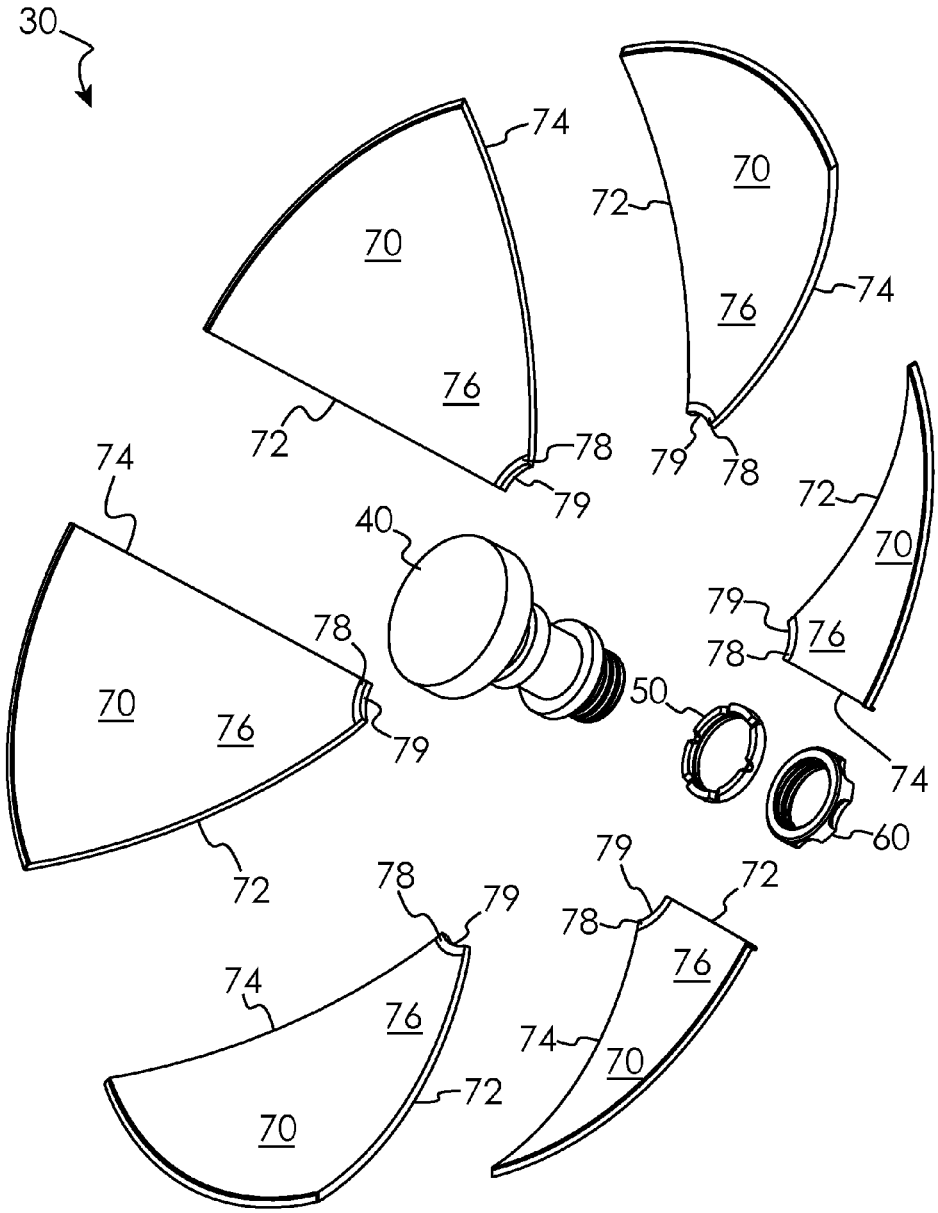
FIG. 1 is an exploded perspective view of a segmented parabolic antenna.

For the purpose of promoting an understanding of the claims, reference will now be made to certain embodiments thereof and specific language will be used to describe the same. It will nevertheless be understood that no limitation of the scope of this disclosure and the claims is thereby intended, such alterations, further modifications and further applications of the principles described herein being contemplated as would normally occur to one skilled in the art to which this disclosure relates. In several figures, where there are the same or similar elements, those elements are designated with the same or similar reference numerals.

The present disclosure relates to segmented antenna reflectors and the antennas that utilize such reflectors. The illustrated embodiments utilize a parabolic reflector for exemplary illustration only, it being recognized that the principles of the present disclosure are applicable to antenna reflectors of any shape and dimension. For example, reflectors in the shape of other conic sections, off-center reflectors, flat reflectors and Cassegrain reflectors may also be used with the principles of the present disclosure, to give just a few non-limiting examples.

Referring now to FIG. 1, parabolic antenna 30 is illustrated in an exploded assembly view. Parabolic antenna 30 is made up of a plurality of dish segments 70 which, when placed in a side-by-side orientation, form a three dimensional reflector, such as a parabolic reflector, to give just one non-limiting example. Each of the dish segments 70 generally include first sidewalls 72 and second sidewalls 74, surface 76 and mounting portion 78 including end wall 79. The parabolic antenna 30 further includes a retainer 50 and nut 60 that function to hold the parabolic antenna 30 in its assembled form, as described in greater detail hereinbelow. The parabolic antenna 30 further includes a transceiver 40. When transmitting, the transceiver 40 emits electromagnetic energy toward the parabolic reflector which reflects the energy in a wider beam parallel to the long axis of the transceiver 40. When receiving, electromagnetic energy impinging upon the parabolic reflector is reflected toward the transceiver 40 (located at or near the focus of the parabola), thereby concentrating the received electromagnetic energy at the transceiver 40.

Figure 3:
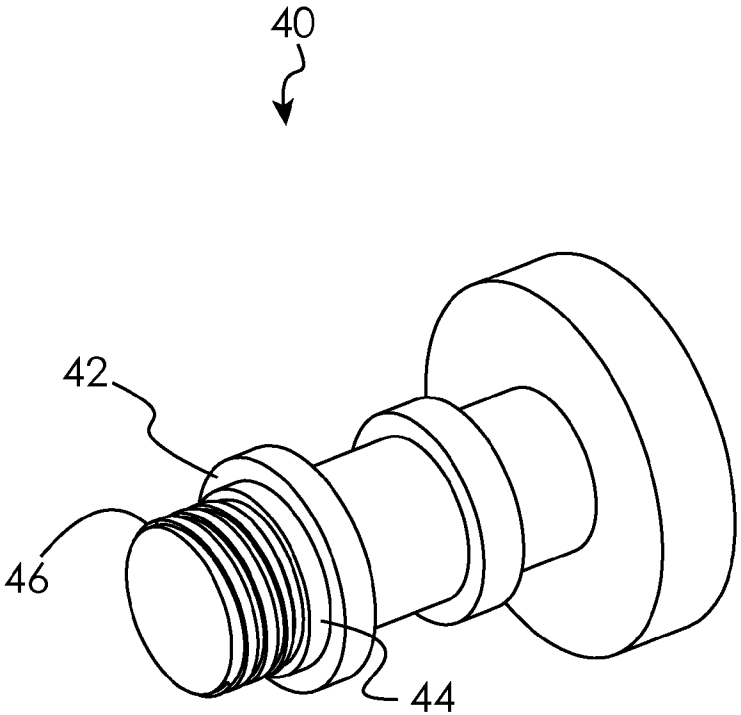
FIG. 3 is a perspective view of the FIG. 2 transceiver.
Figure 2:
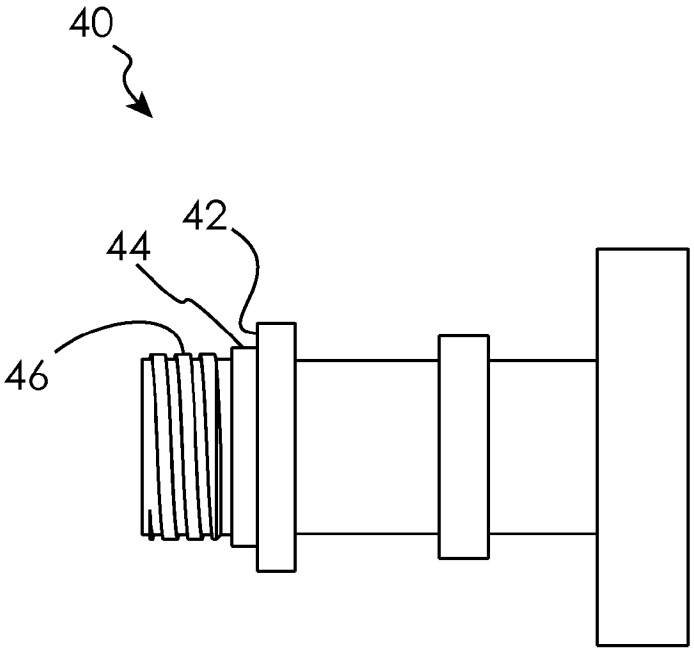
FIG. 2 is a half-sectional view of a transceiver, a component of the FIG. 1 segmented parabolic antenna.
Figure 5:
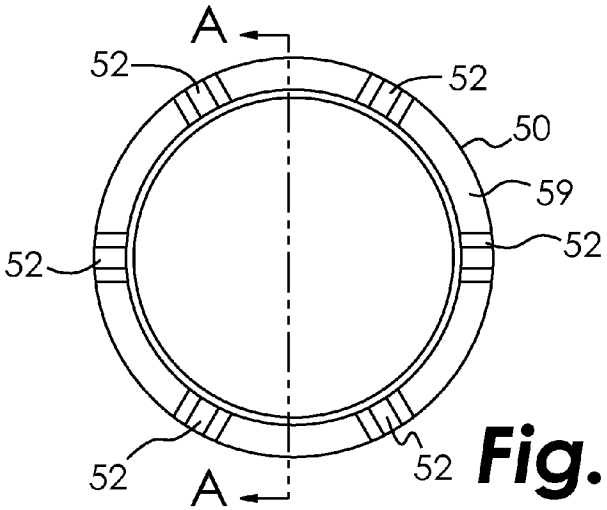
FIG. 5 is a top plan view of the FIG. 4 retainer.
Figure 7:
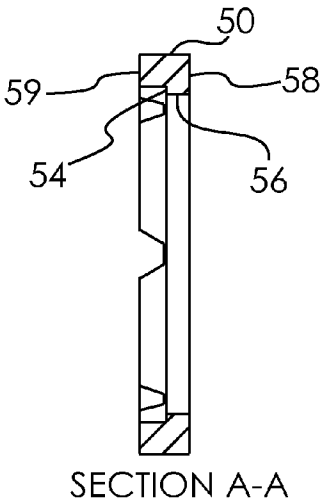
FIG. 7 is a cross-sectional view taken along line A-A of FIG. 5.
Figure 4:
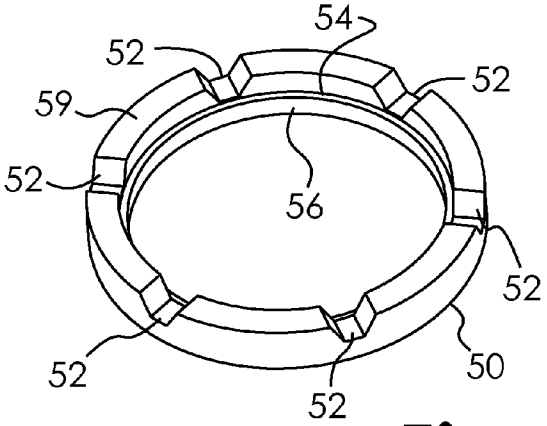
FIG. 4 is a perspective view of a retainer, a component of the FIG. 1 segmented parabolic antenna.
Figure 6:
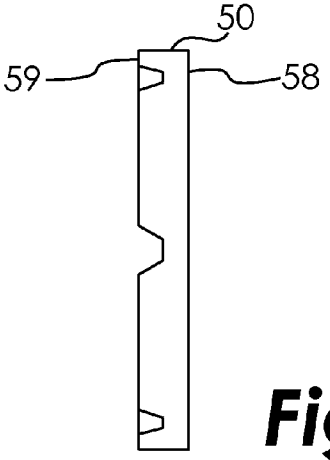
FIG. 6 is a side-elevational view of the FIG. 5 retainer.
Figure 9:
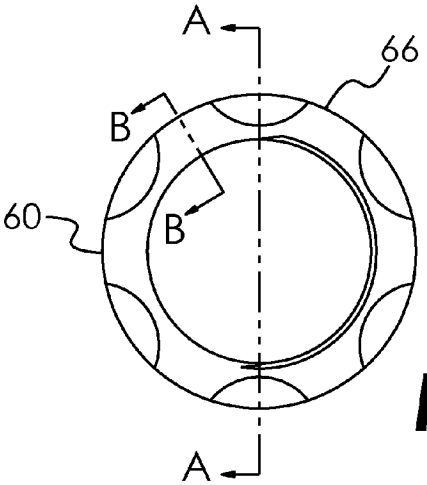
FIG. 9 is a top plan view of the FIG. 8 nut.
Figure 8:
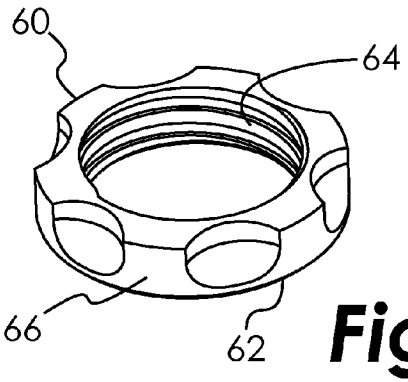
FIG. 8 is a perspective view of a nut, a component of the FIG. 1 segmented parabolic antenna.
Figure 11:
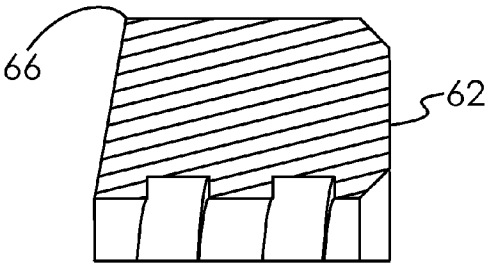
FIG. 11 is a partial cross-sectional view taken along line B-B of FIG. 9.
Figure 10:
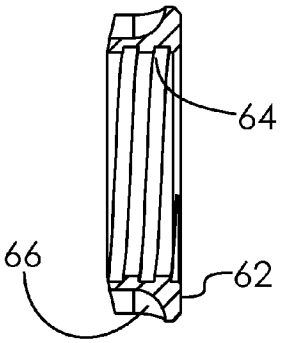
FIG. 10 is a cross-sectional view taken along line A-A of FIG. 9.

Referring now to FIGS. 2 and 3, transceiver 40 generally includes shoulder 42, retaining portion 44 and externally threaded portion 46. The interior edges of the antenna segments 70 (i.e. mounting portion 78 including end wall 79) engage the shoulder 42 and retaining portion 44 when the parabolic antenna 30 is assembled, as described in greater detail hereinbelow. The illustrated transceiver is shown for example only. The physical configuration of the transceiver can take a great many shapes, the details of which are not critical to the majority of the presently disclosed embodiments.

Referring now to FIGS. 4-7, retainer 50 is used to also engage the interior edges (i.e. mounting portion 78 including end wall 79) of the antenna segments 70 when the parabolic antenna 30 is assembled, as described in greater detail hereinbelow. Retainer 50 generally includes a plurality of notches 52, shoulder 54, bore 56, and surfaces 58 and 59.

Referring now to FIGS. 8-11, nut 60 interfaces with both the transceiver 40 and the retainer 50 in order to complete the assembly of the parabolic antenna 30. Nut 60 generally includes surface 62, internally threaded portion 64 and grip 66. The internally threaded portion 64 engages the externally threaded portion 46 of transceiver 40 as described in greater detail hereinbelow.

Figure 12:
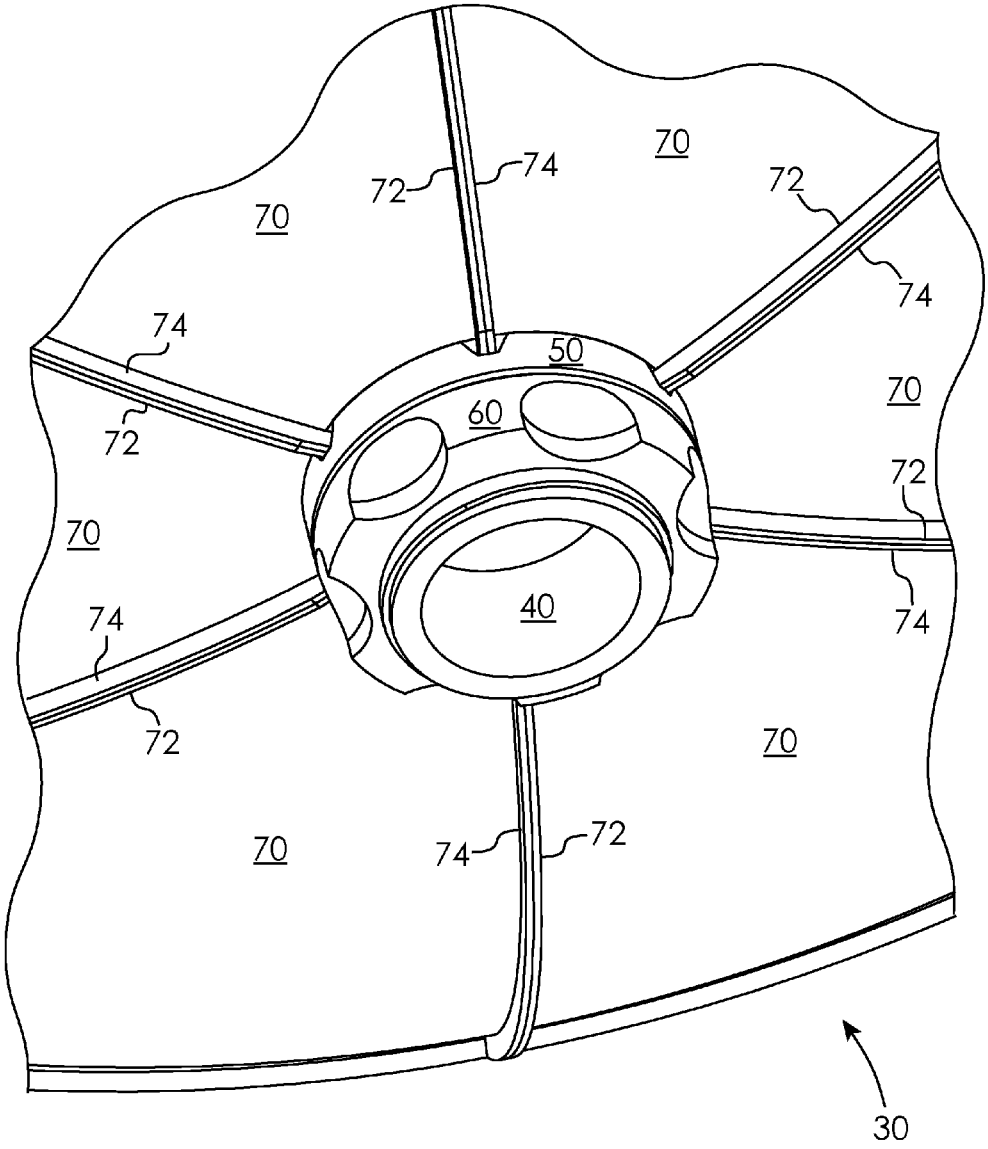
FIG. 12 is a partial bottom perspective view of the FIG. 1 segmented parabolic antenna assembled.
Figure 13:
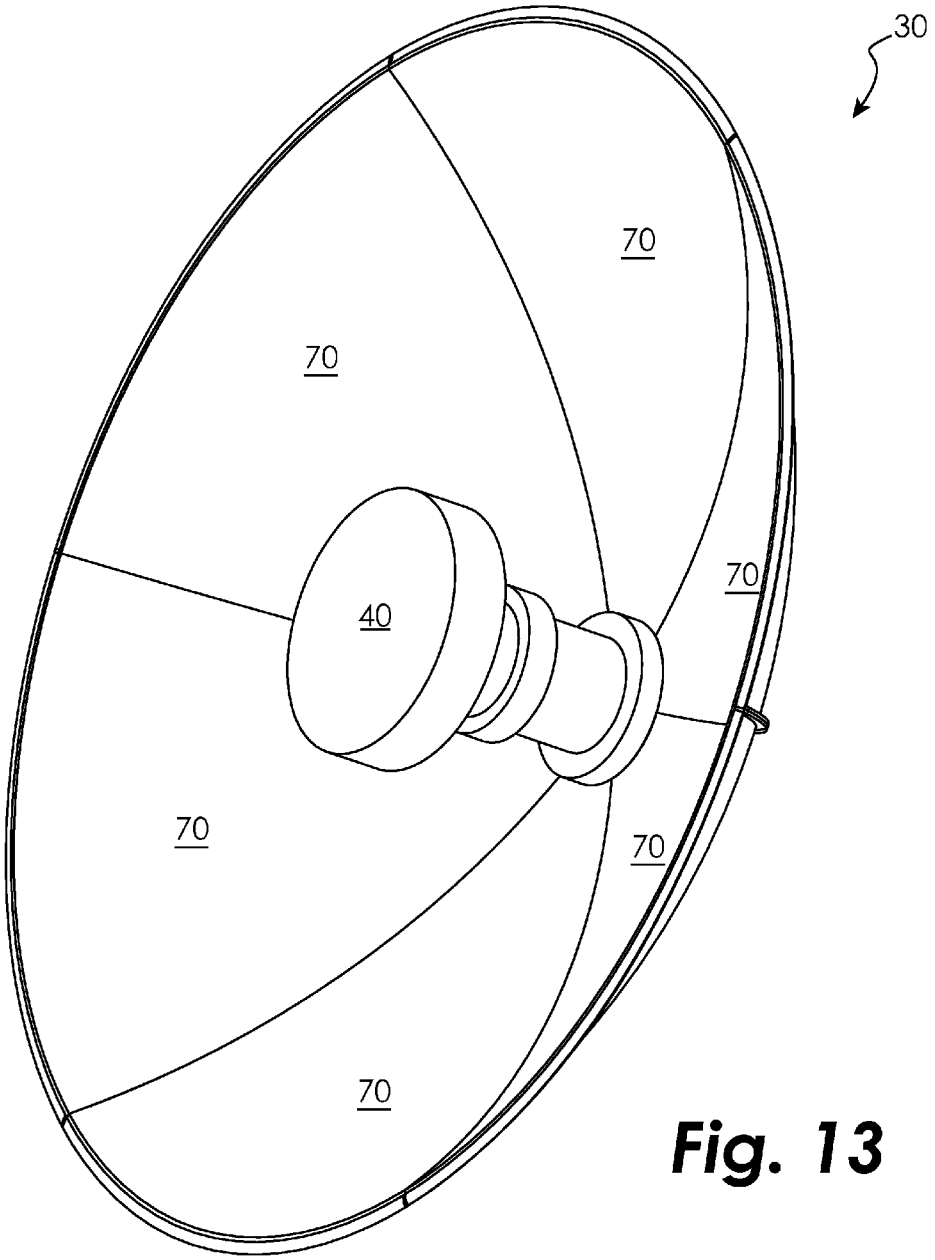
FIG. 13 is a top perspective view of the FIG. 1 segmented parabolic antenna assembled.
Figure 14:
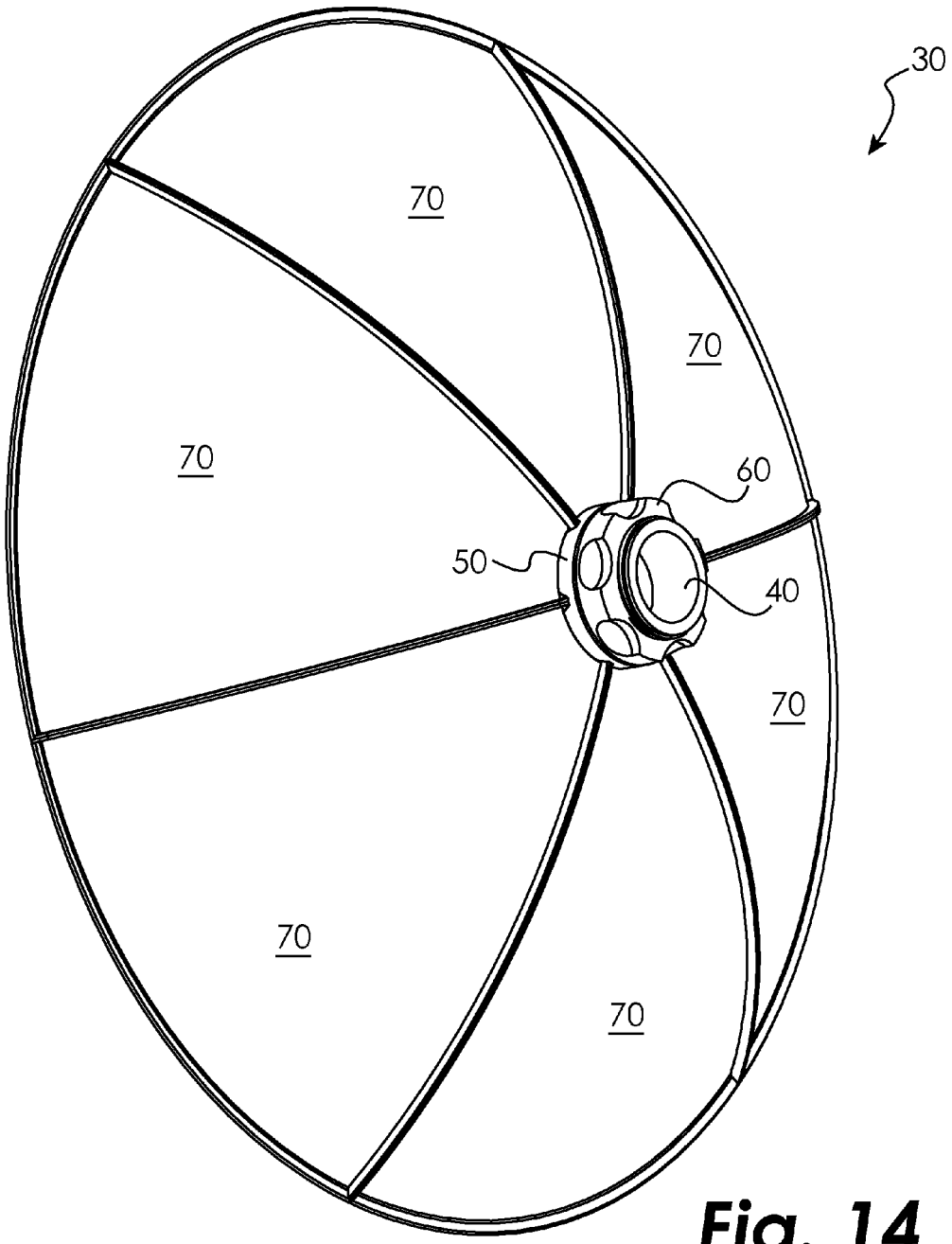
FIG. 14 is a bottom perspective view of the FIG. 1 segmented parabolic antenna assembled.

Referring now to FIGS. 12-14, parabolic antenna 30 is illustrated as assembled with the plurality of dish segments 70 clamped between transceiver shoulder 42 and retainer surface 59 and/or retainer shoulder 54 in the region of transceiver retaining portion 44. Internally threaded portion 64 of nut 60 threadingly engages the externally threaded portion 46 of transceiver 40 with nut surface 62 bearing on retainer surface 58, thereby clamping dish segments 70 together in the region of segment 70 mounting portion 78 between retainer surface 59 and/or retainer shoulder 54 and transceiver shoulder 42. As illustrated when clamped, segment 70 sidewalls 72 and 74 are held adjacent to neighboring segment 70 sidewalls 72 and 74, with each pair of neighboring sidewalls 72 and 74 passing through one of the notches 52 in retainer 50.

Figure 15:
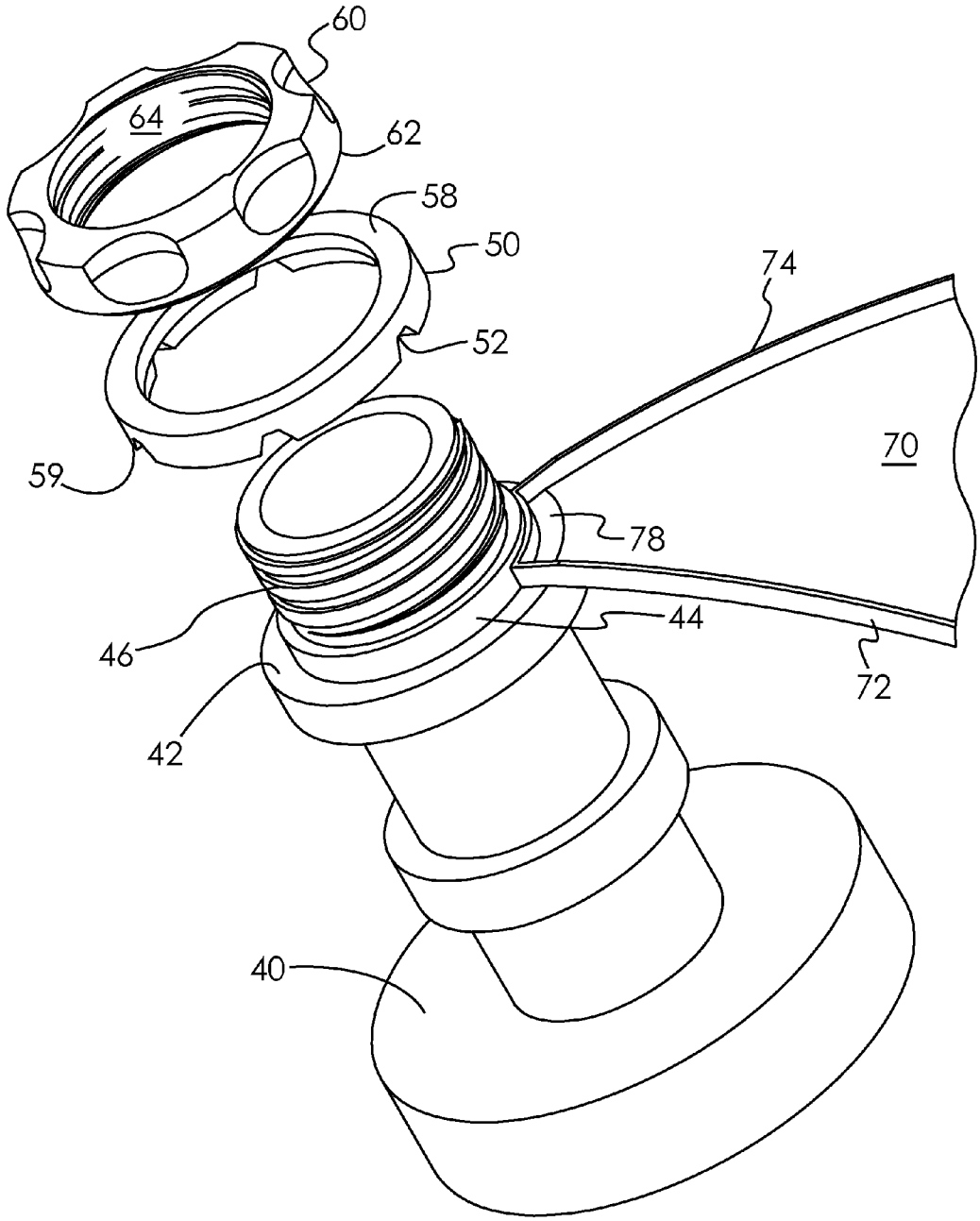
FIG. 15 is a perspective view of the FIG. 1 segmented parabolic antenna during an initial assembly step with a single dish segment, a component of the FIG. 1 segmented parabolic antenna.
Figure 16:
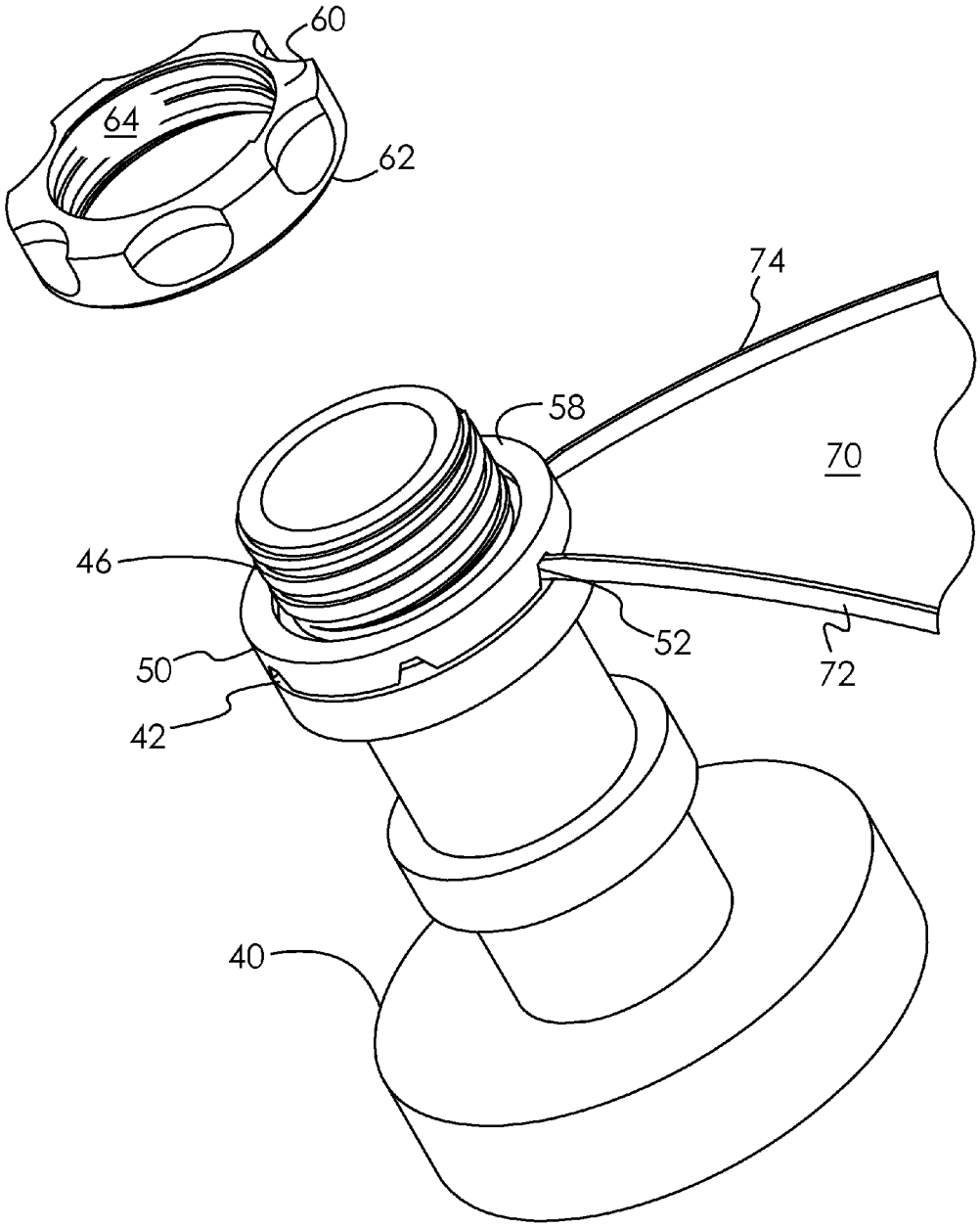
FIG. 16 illustrates an assembly step subsequent to the FIG. 15 assembly.
Figure 17:
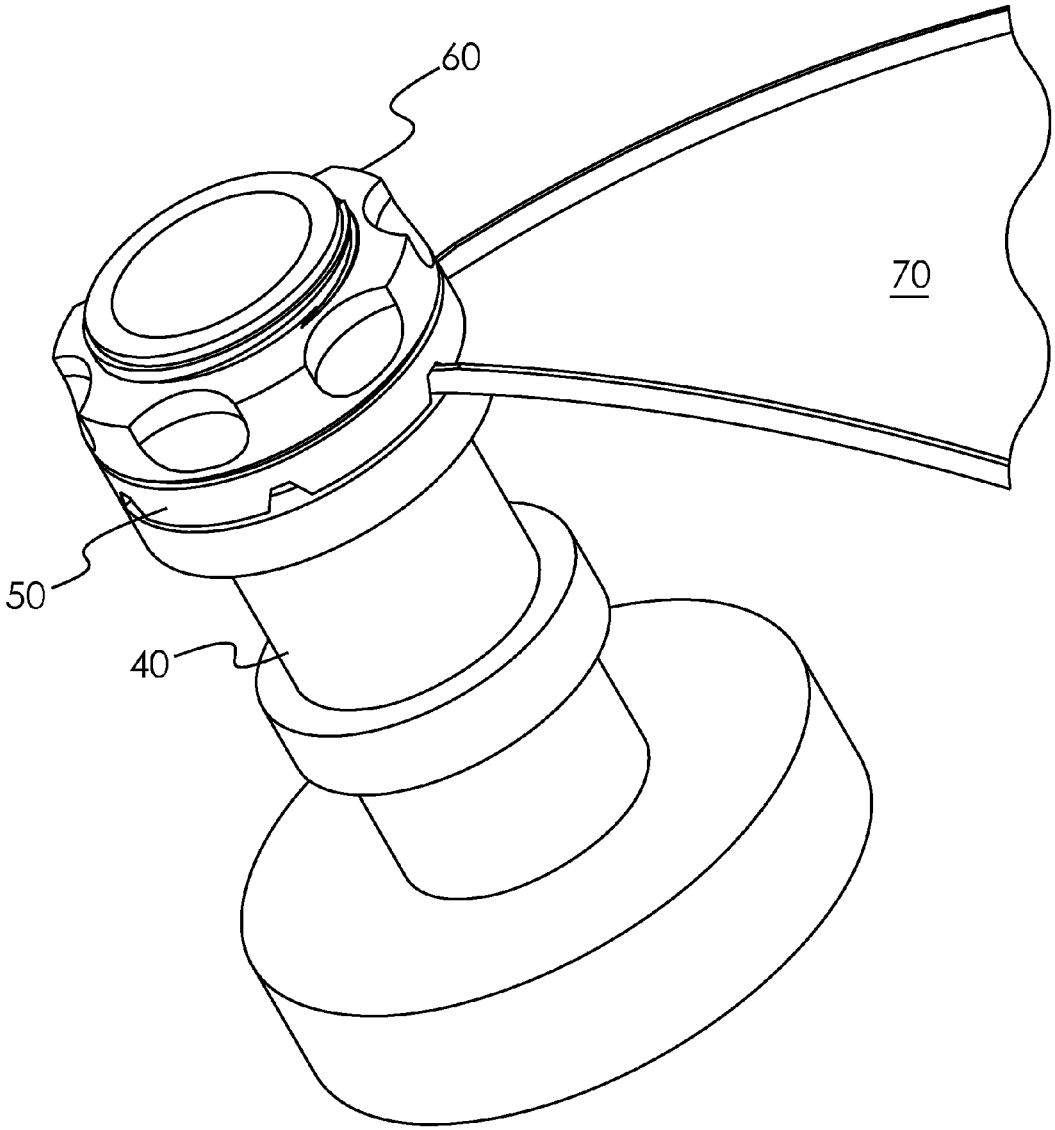
FIG. 17 illustrates a final assembly of the FIG. 15 assembly.

Referring now to FIGS. 15-17, an assembly sequence is illustrated for the parabolic antenna 30 utilizing a single dish segment 70 as an example. As shown in FIG. 15, mounting portion 78 of segment 70 is initially located against shoulder 42 and retaining portion 44 of the transceiver 40. As shown in FIG. 16, retainer 50 is then located over externally threaded portion 46 of the transceiver 40 so that retainer surface 59 and/or retainer shoulder 54 bears against segment 70 mounting portion 78 with sidewalls 72 and 74 passing through one of the retainer notches 52. As shown in FIG. 17, nut 60 is then engaged with transceiver 40 by threadingly engaging the nut internally threaded portion 64 onto the transceiver externally threaded portion 46 so that nut 60 is tightened against retainer 50 and transceiver 40 with nut surface 62 bearing on retainer surface 58, resulting in retainer surface 59 and/or retainer shoulder 54 clamping dish segment 70 against transceiver shoulder 42.

FIGS. 15-17 illustrate the assembly of just one segment 70. When assembling the full parabolic antenna 30, the transceiver 40 may be positioned on a relatively flat surface and each of the segments 70 can be arranged around the transceiver 40, with the mounting portion 78 and end wall 79 of each segment 70 resting against the shoulder 42 and retaining portion 44 of transceiver 40. The outer end of each segment 70 may rest upon the surface supporting the transceiver 40. In this position, the parabola antenna 30 is in a roughly parabolic shape, but none of the pieces are actually coupled together. The retainer 50 may then be slid over the transceiver 40 until each of the retainer notches 52 captures adjacent segment 70 sidewalls 72 and 74. Alternatively, the retainer 50 may be placed over the transceiver 40 prior to positioning the segments 70, and the retainer 50 may be lifted slightly each time a segment 70 is positioned onto the transceiver 40. In any case, once all of the segments 70 are in position, nut 60 may be threadingly engaged with the transceiver 40 to tighten the retainer 50 against the segements, thereby securely capturing the segements 70 by forcing the retainer surface 59 and/or retainer shoulder 54 to clamp all of the dish segments 70 against transceiver shoulder 42. In this position, the parabolic antenna 30 is ready for use.

Disassembly of parabolic antenna 30 is performed by removing nut 60 from transceiver 40 by unthreading the nut internally threaded portion 64 from the transceiver externally threaded portion 46, and then removing nut 60 and retainer 50. This permits the dish segments 70 to be easily removed and separated for storage or transportation. It will be appreciated that the assembly and disassembly of the parabolic antenna 30 is extremely quick and simple, and the disassembled parabolic antenna 30 may be stored in a small space.

Referring now to FIGS. 18-23, an alternative embodiment is illustrated utilizing magnetic fasteners affixed to dish segments 170. Other than the modifications described below the transceiver 40, retainer 50 and nut 60 illustrated in FIGS. 18-23 are similar to the same features illustrated and described with respect to FIGS. 1-17. Many of the same elements and relationships apply to the alternate embodiments described below, as will be appreciated by those skilled in the art.

Figure 18:
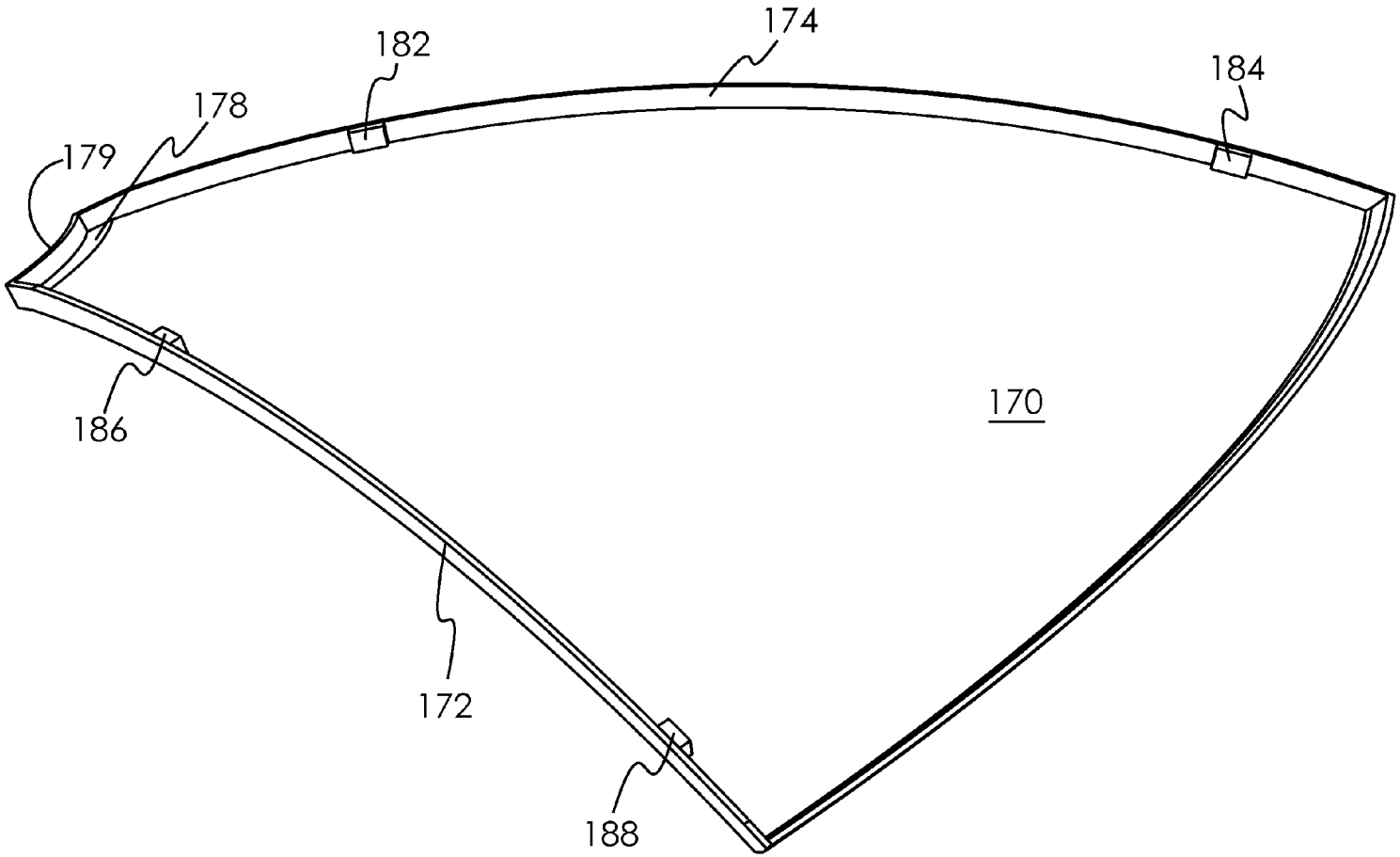
FIG. 18 illustrates an alternative embodiment of a dish segment.

Referring now to FIG. 18, dish segment 170 is illustrated. Dish segment 170 generally includes first side wall 172 and second sidewall 174, mounting portion 178, end wall 179 and magnets 182, 184, 186 and 188. Magnets 182 and 184 are located on side wall 174 and magnets 186 and 188 are located on side wall 172.

Figure 19:
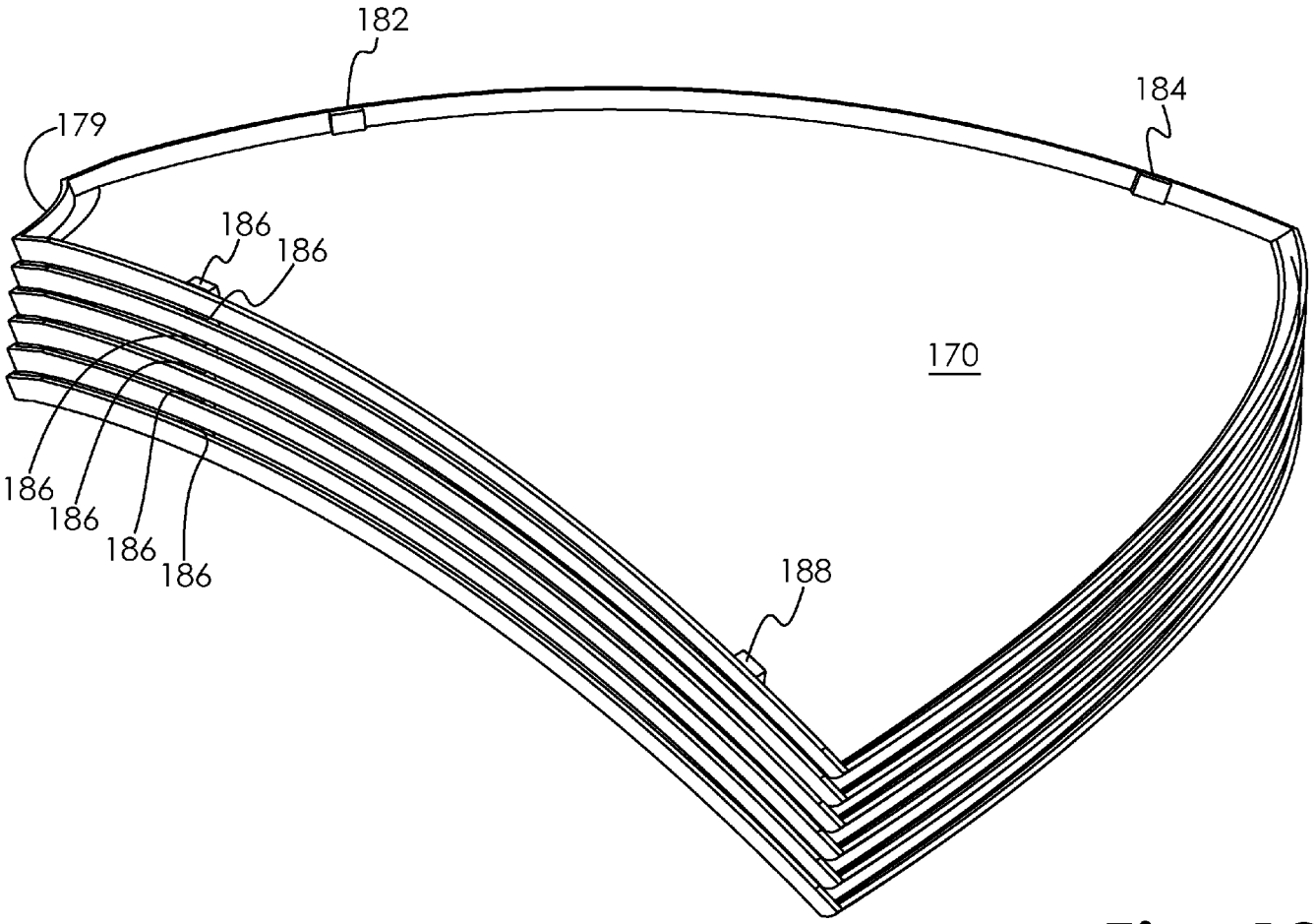
FIG. 19 illustrates a plurality of the FIG. 18 dish segments stacked together.

Referring now to FIG. 19, six dish segments 170 are illustrated in a stack configuration with respective magnets in adjacent segments 170 stacked on top of each other. In one embodiment, the plurality of magnets 186 are attracted to each other in this type of configuration. Similarly, the plurality of magnets 182, 184 and 188 are attracted to their like number, holding the stack in a convenient compact unit when in storage or transport. The mutual attraction of the respective magnets tends to prevent the stack from becoming separated unless a force that exceeds the magnetic force of attraction is applied to separate the segments 170 in the stack.

Figure 20:
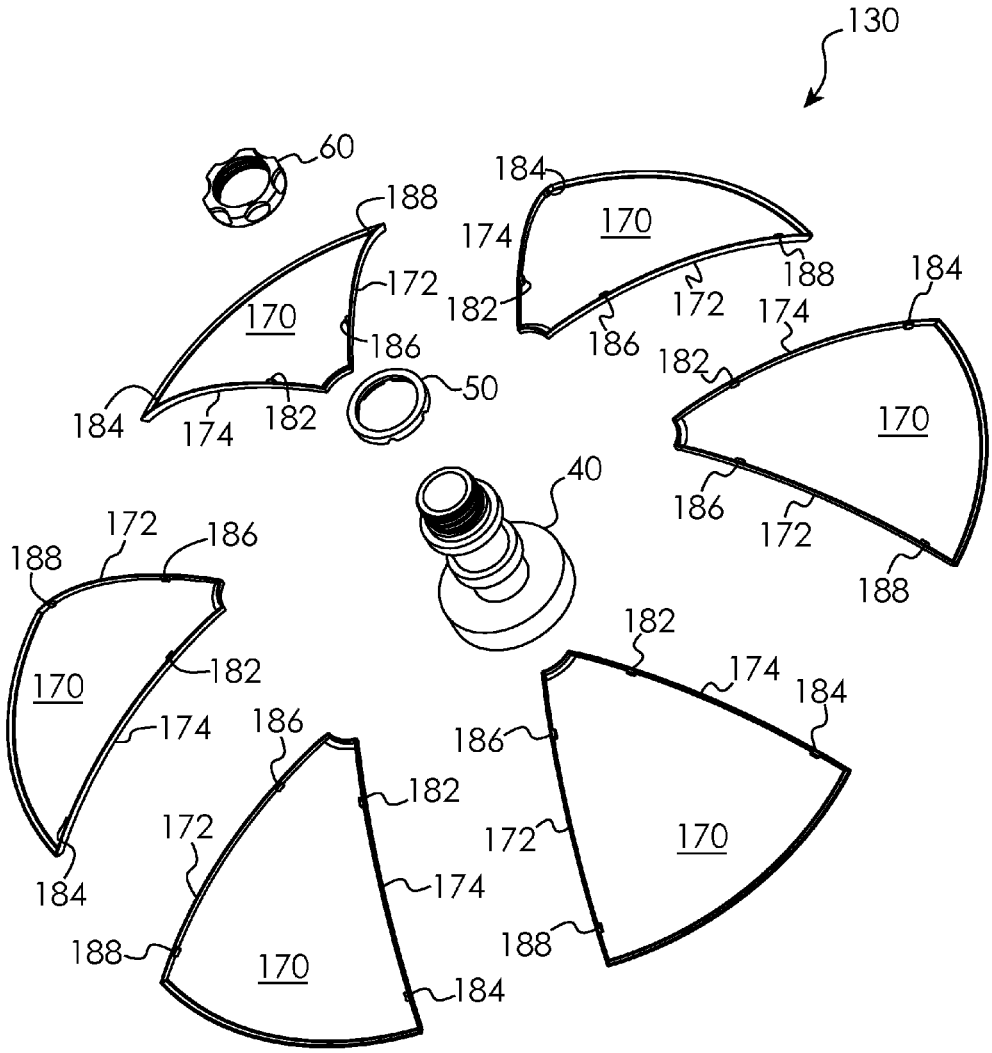
FIG. 20 illustrates an exploded perspective view of an alternative embodiment of a segmented parabolic antenna.

Referring now to FIG. 20, parabolic antenna 130 is illustrated in an exploded assembly view. In various embodiments, magnets 182 and 186 are configured and arranged to magnetically attract to each other in the illustrated orientation. Similarly, magnets 188 and 184 are constructed and arranged to attract each other in the illustrated orientation so that the plurality of dish segments 170 can be assembled into a parabolic antenna surface with dish segments 170 having sufficient attractive force to the adjacent neighboring segments 170 to hold the dish segments 170 in close proximity without retainer 50 or nut 60 being engaged on transceiver 40.

Figure 21:
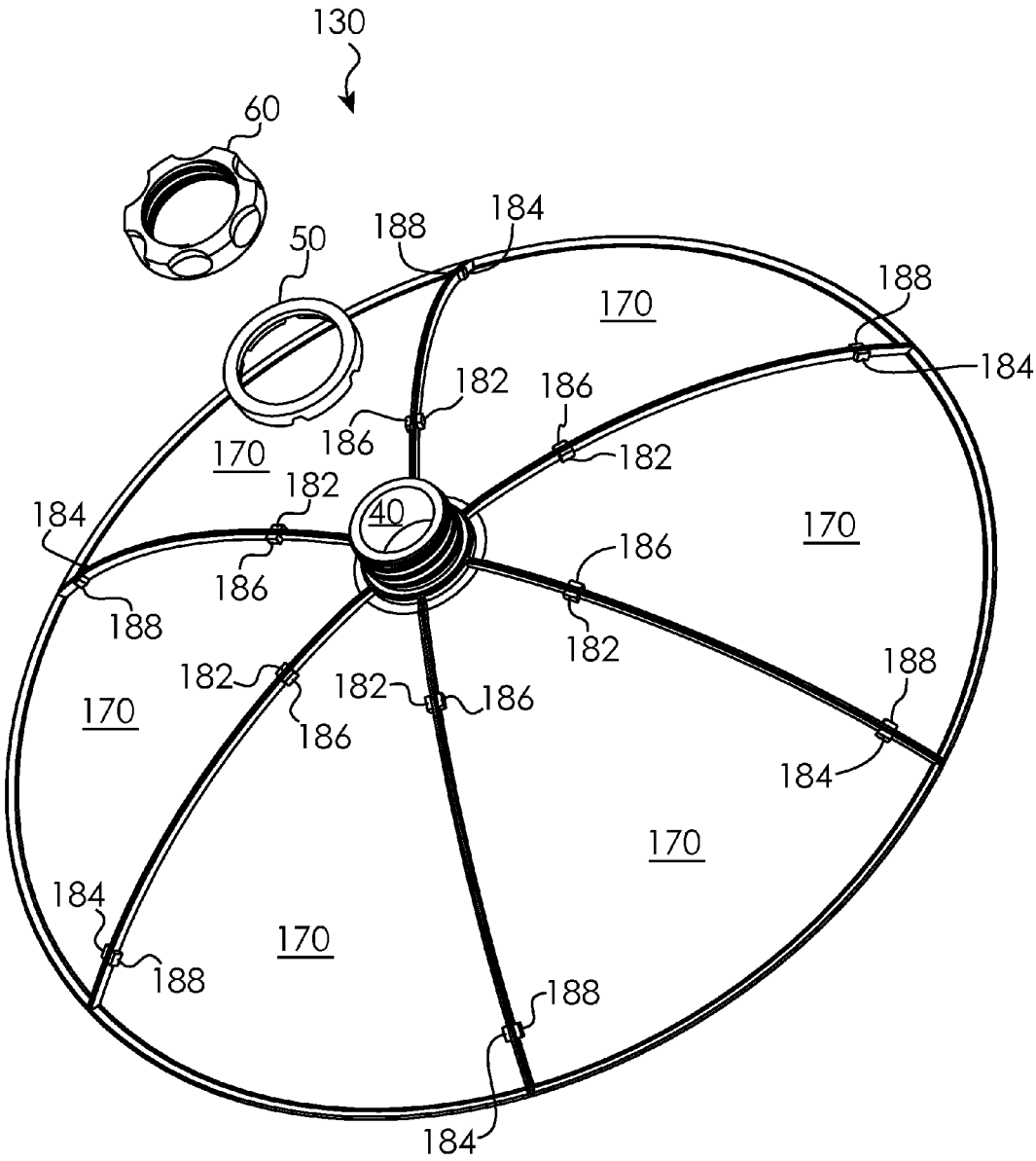
FIG. 21 illustrates a bottom perspective view of the FIG. 20 segmented parabolic antenna in an initial assembly configuration.
Figure 22:
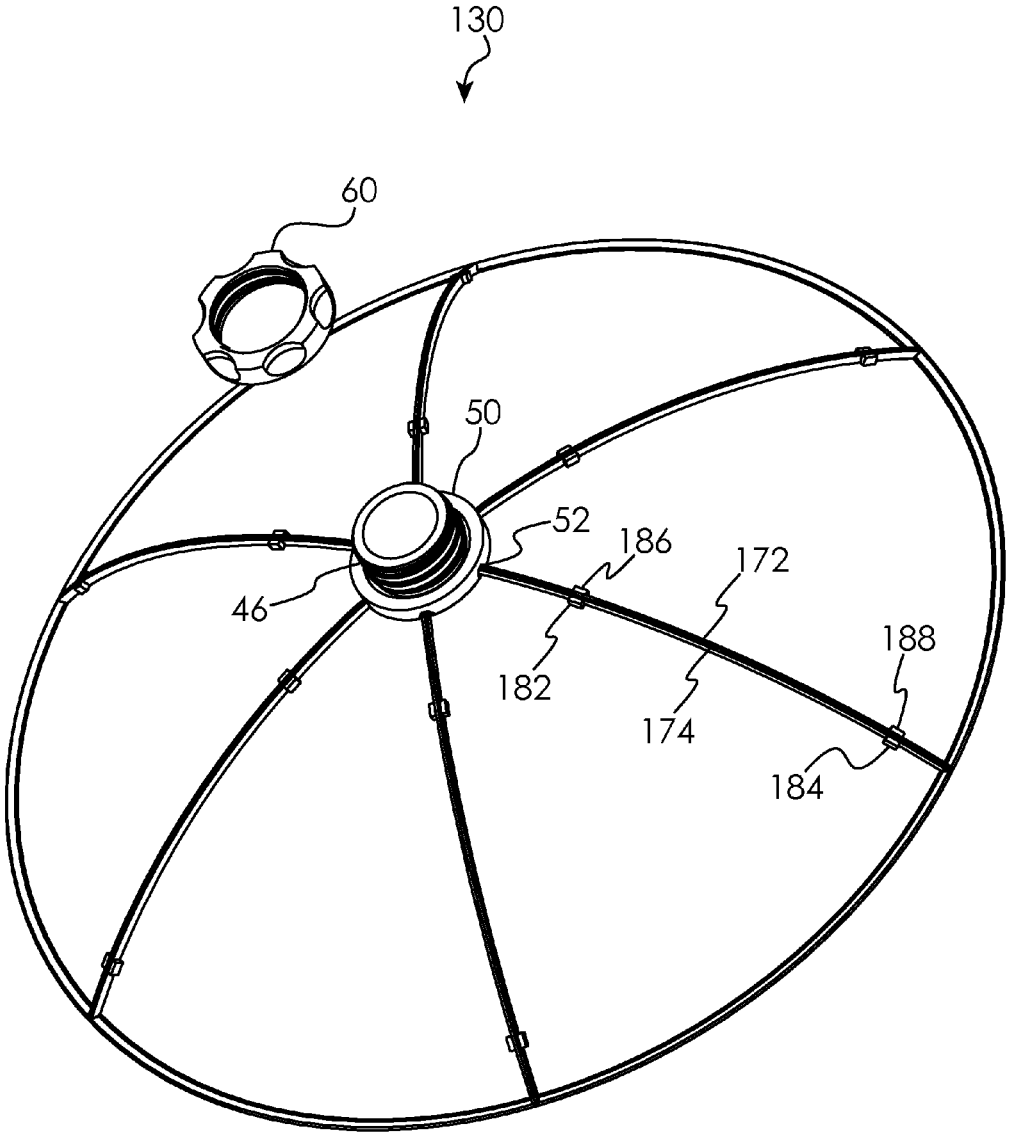
FIG. 22 illustrates a bottom perspective view of the FIG. 21 assembly in a subsequent assembly step.
Figure 23:
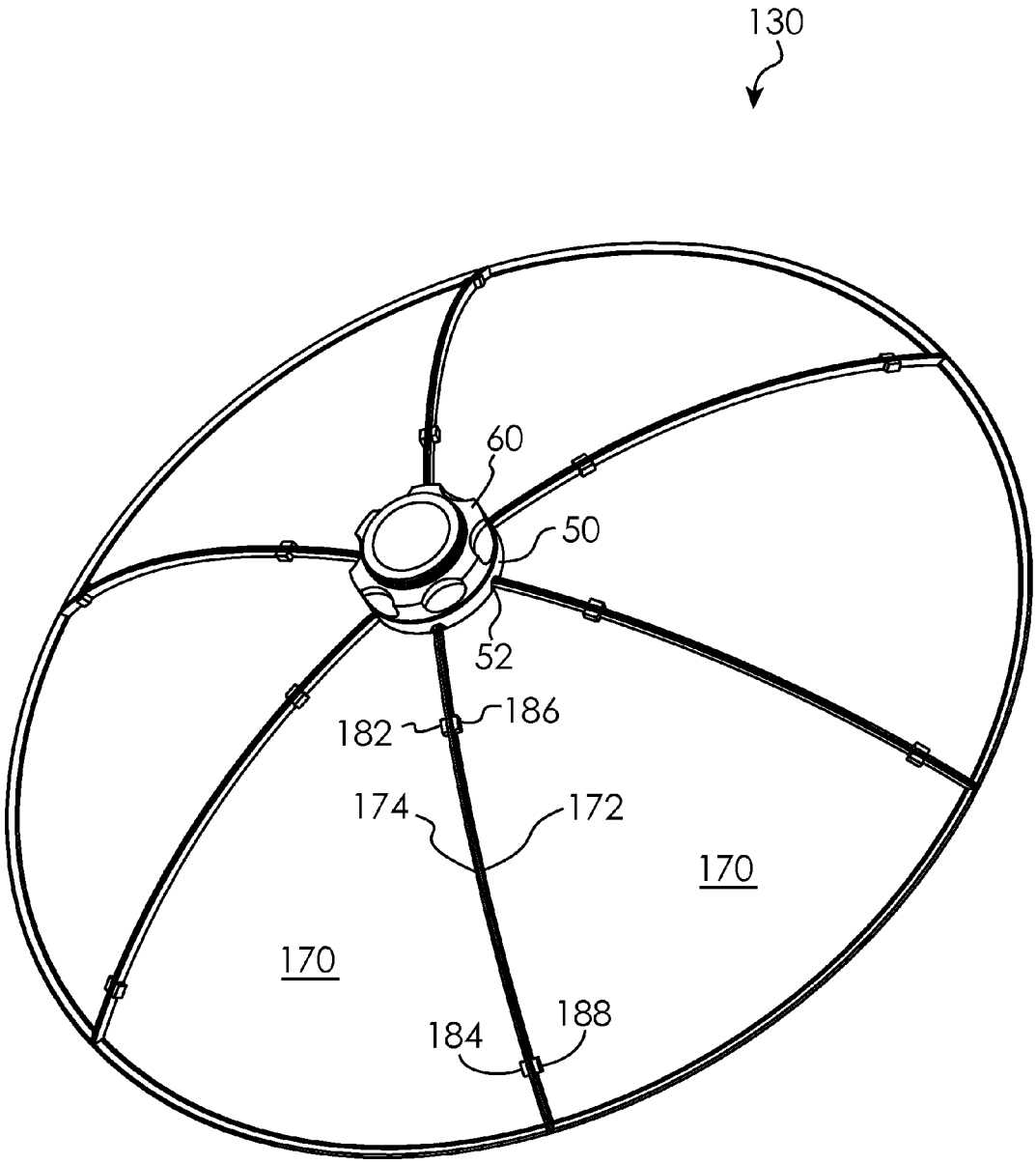
FIG. 23 illustrates a bottom perspective view of the FIG. 21 assembly in a final assembly.

Referring now to FIGS. 21-23, parabolic antenna 130 is illustrated in consecutive stages of assembly. In FIG. 21, dish segments 170 are held together utilizing magnets 182, 184, 186 and 188 in a general parabolic configuration with externally threaded portion 46 passing through the center hole formed by the dish segments 170. Although illustrated with the transceiver 40 passing through the center of the assembled segments 170, in certain embodiments the attractive force of the magnet pairs is such that the parabolic shape of the combined segments 170 is retained even without the transceiver 40 being in place. In certain embodiments, the segments 170 will "snap" together as soon as two segments 170 are brought into close enough proximity to cause the force of magnetic attraction to pull the segments 170 together. The assembly of the parabolic reflector is thereby greatly simplified, as the parabolic reflector essentially self-forms as the segments 170 are brought into rough alignment. Retainer 50 and nut 60 are shown in FIG. 21 positioned for later assembly onto transceiver 40 externally threaded portion 46. In FIG. 22, retainer 50 is positioned over externally threaded portion 46 with notches 52 assembled over sidewalls 172 and 174.

Referring now to FIG. 23, parabolic antenna 130 is shown in a fully assembled condition with nut 60 fully threadingly engaged with transceiver 40 via internally threaded portion 64 engaging externally threaded portion 46, with retainer 52 and mounting portions 178 clamped there between.

Disassembly of parabolic antenna 130 is performed by removing nut 60 from transceiver 40 by unthreading internally threaded portion 64 from externally threaded portion 46 and then removing nut 60 and retainer 50, thereby permitting dish segments 170 to be removed and separated for storage or transportation. It will be appreciated that the magnets 182-186 facilitate arrangement of the segments 170 into the stack configuration of FIG. 19 after disassembly, with the segments 170 "snapping" into alignment as the segments 170 are brought into close proximity.

Dish segments 70 and 170 can be constructed of any suitable material for use as an antenna. In one embodiment, dish segment 70 and 170 are constructed of a carbon fiber composite material and molded in the appropriate shape.

Regarding magnets 182, 184, 186 and 188, these magnets can be affixed to sidewalls 172 and 174 using any appropriate means. In one embodiment, magnets 182, 184, 186 and 188 are integrally molded with dish segment 170. In another embodiment, magnets 182, 184, 186 and 188 are affixed to dish segment 170 using an adhesive. Other means of attachment will be readily apparent to those skilled in the art, and all are considered to be within the scope of the present disclosure.

While the embodiments disclosed herein utilize a threaded nut to achieve a clamping force with transceiver 40, any other known means for clamping known in the art can be utilized as a substitute. In embodiments utilizing magnets 182, 184, 186 and 188, a clamp can be optionally omitted with transceiver 40 held in position by any way known in the art, including manually holding transceiver 40 in position.

Referring now to FIGS. 24-29, alternative embodiments are illustrated utilizing detents to align dish segments 270. Other than the modifications described below the transceiver 40, retainer 50 and nut 60 illustrated in FIGS. 24-29 are similar to the same features illustrated and described with respect to FIGS. 1-17 and 18-23. Many of the same elements and relationships apply to the alternate embodiments described below.

Figure 24:
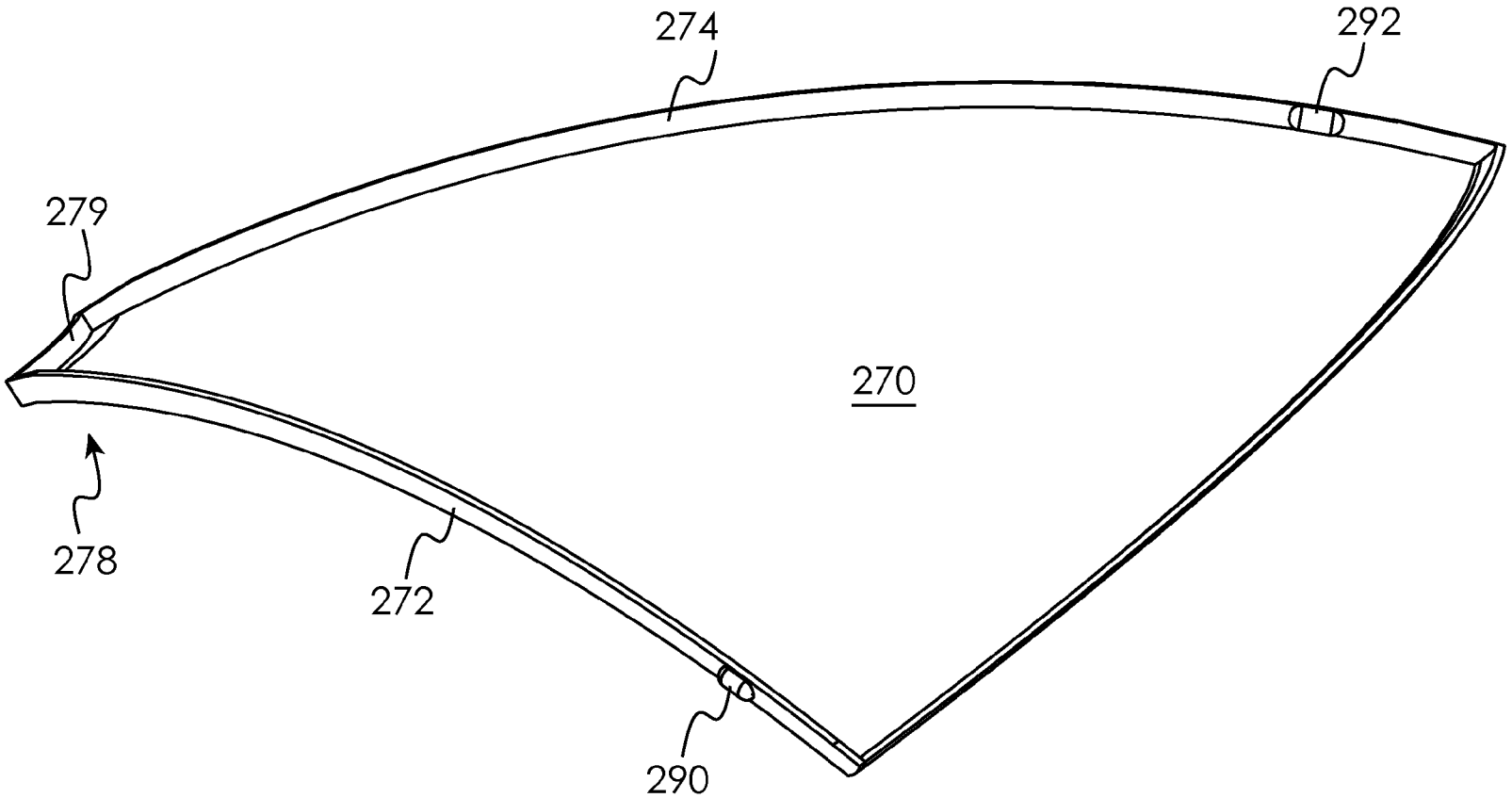
FIG. 24 illustrates a perspective view of an alternative embodiment of a dish segment.
Figure 25:
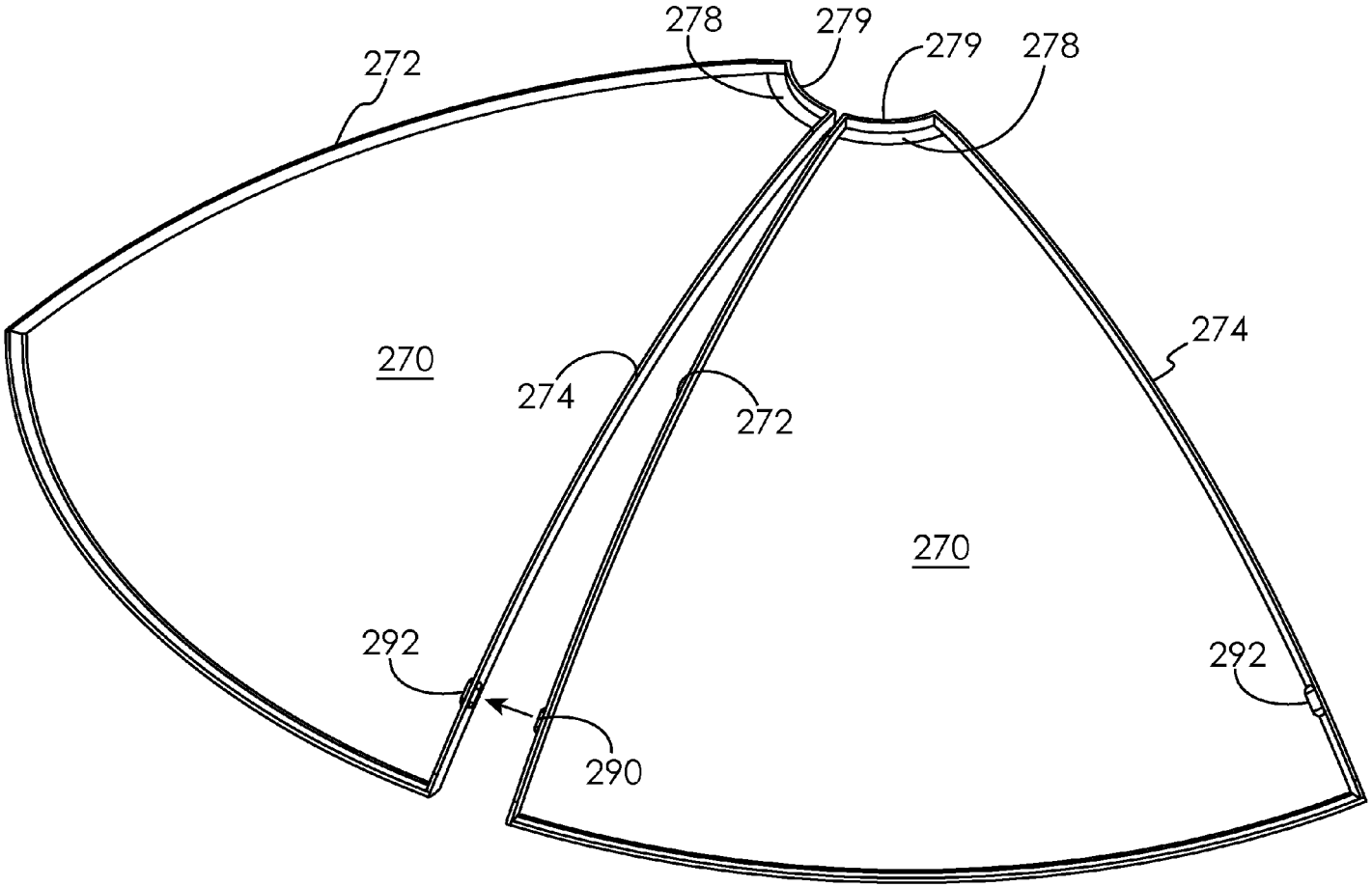
FIG. 25 illustrates a perspective view of two FIG. 24 dish segments aligned for assembly.
Figure 26:
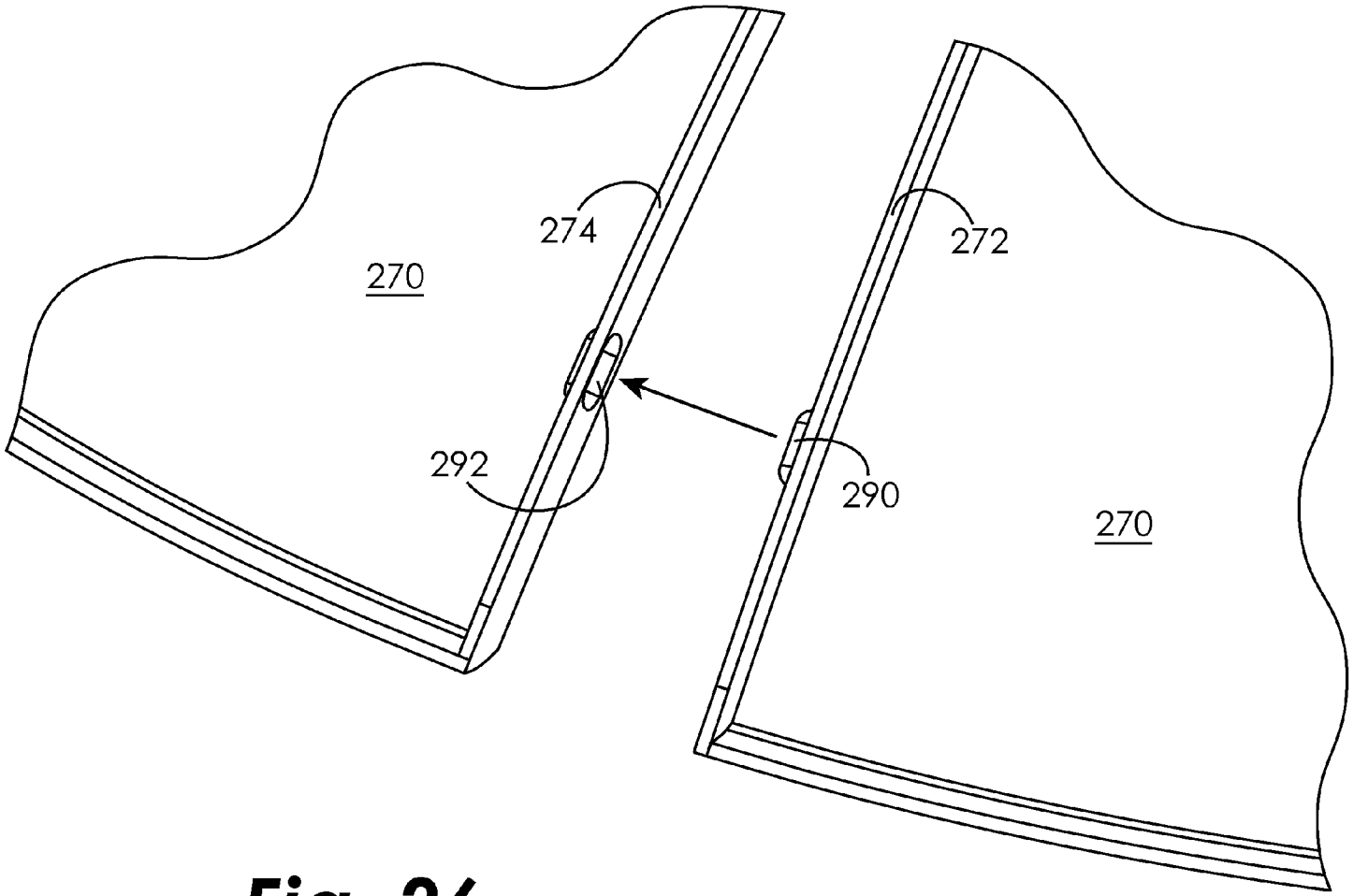
FIG. 26 illustrates a partial perspective view of FIG. 25 illustrating the alignment of detents.

Referring now to FIGS. 24-26, dish segment 270 is illustrated. Dish segment 270 generally includes first sidewall 272 and second sidewall 274, mounting portion 278, end wall 279, male detent 290 and female detent 292. Male detent 290 is located on sidewall 272 and female detent 292 is located on sidewall 274. When dish segments 270 are assembled together to form a parabolic dish as described above, male detent 290 and female detent 292 cooperate to resist relative shear between adjacent dish segments 270 with male detent 290 residing within female detent 292. Male detent 290 is in the form of a rounded protrusion with female detent 292 defining an internal space constructed and arranged to closely receive male detent 290. Alternative embodiments (not illustrated) may use other complementary shapes for male detent 290 and female detent 292, as will be readily apparent to those skilled in the art.

Figure 27:
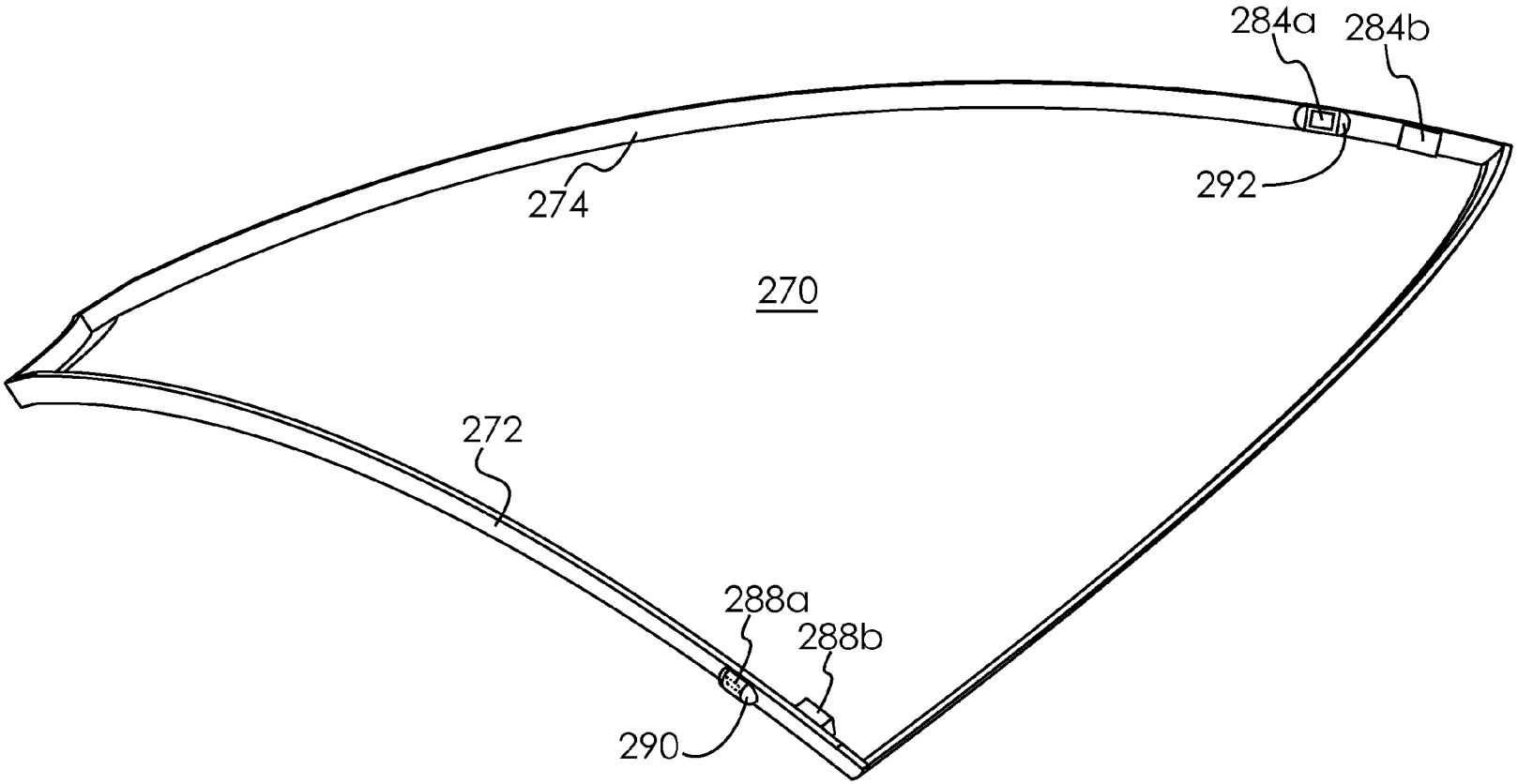
FIG. 27 illustrates a perspective view of an alternative embodiment of a dish segment.
Figure 28:
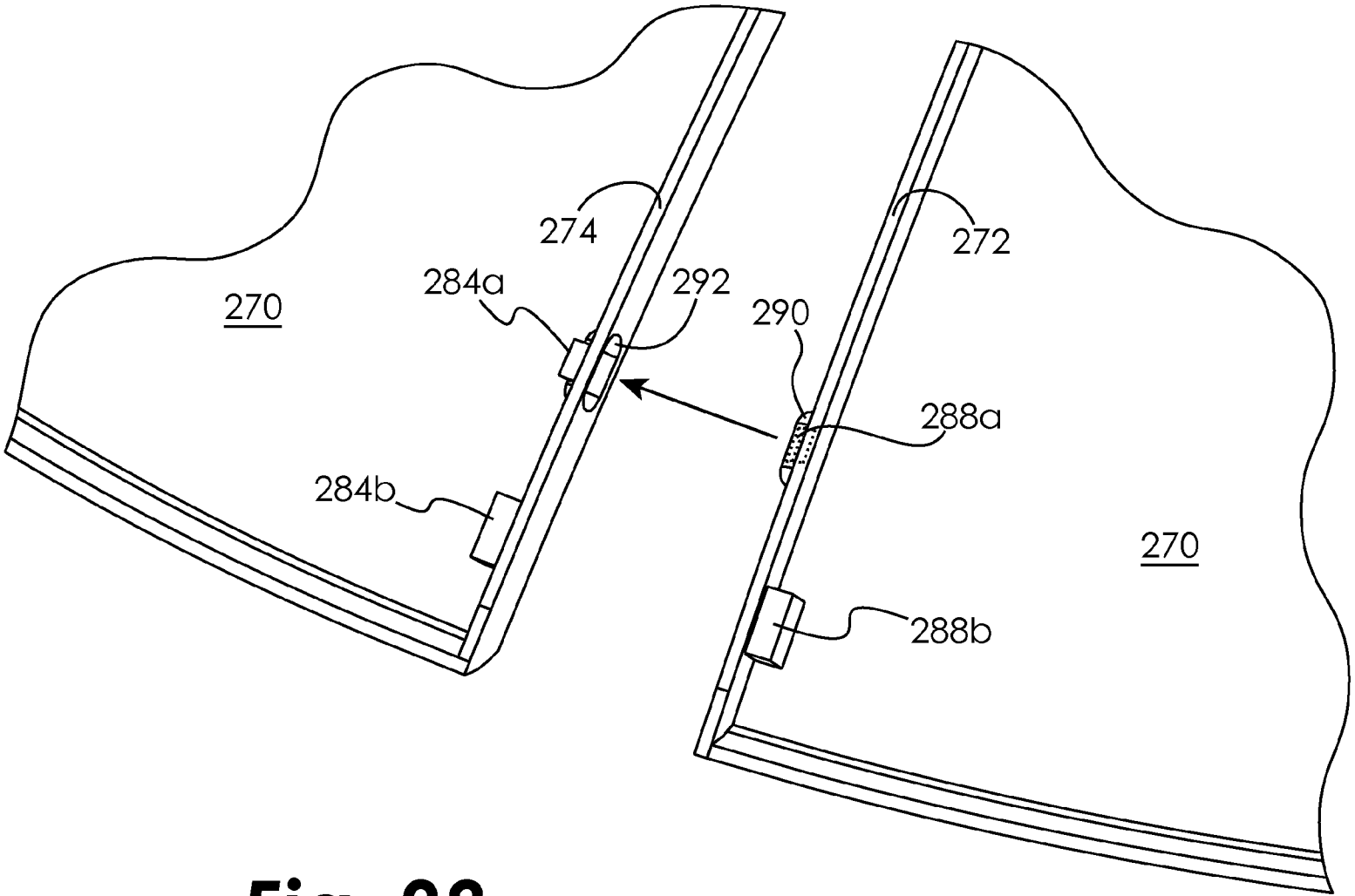
FIG. 28 illustrates a perspective view of two FIG. 27 dish segments aligned for assembly.
Figure 29:
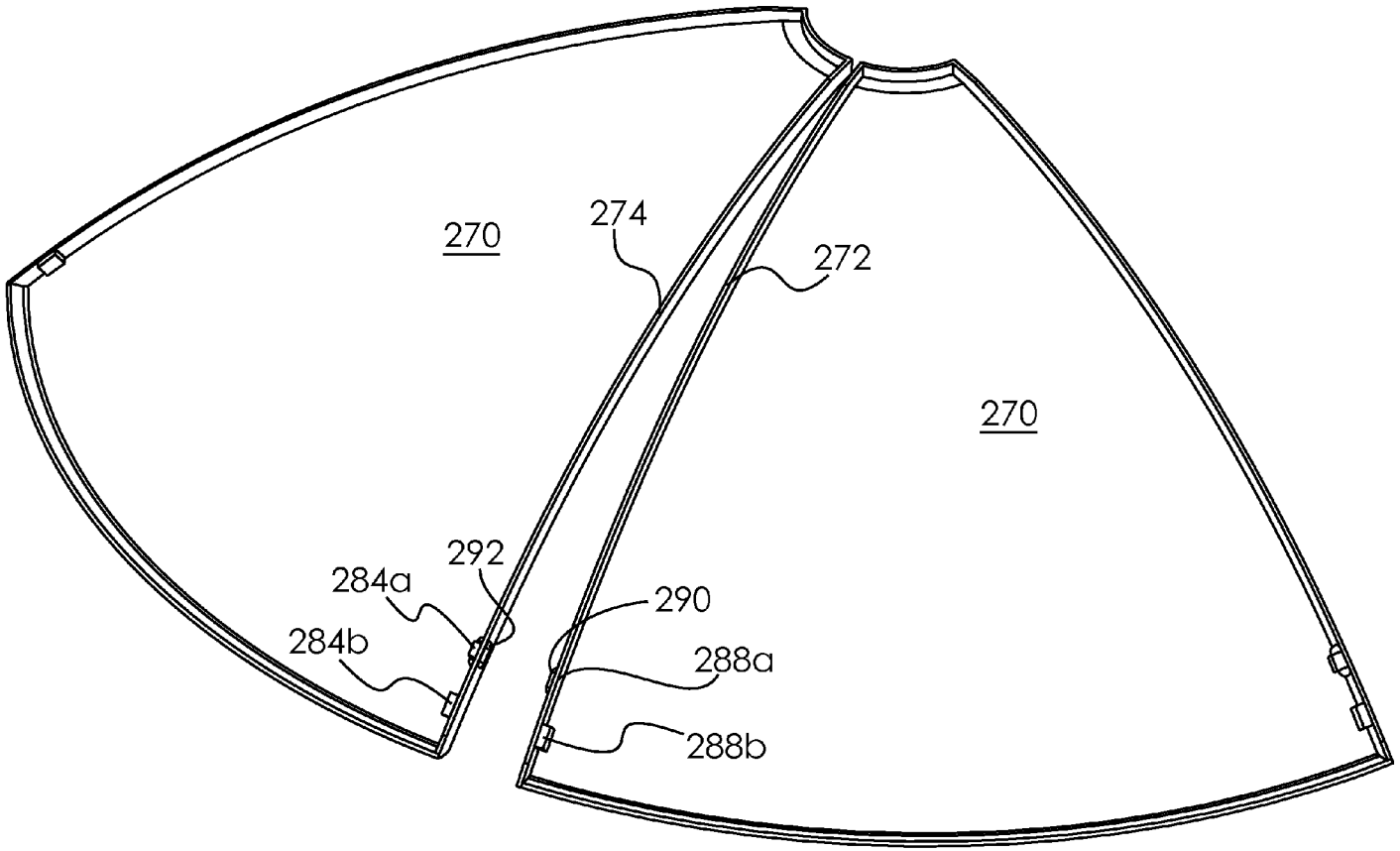
FIG. 29 illustrates a partial perspective view of FIG. 28 illustrating the alignment of detents.

Referring now to FIGS. 27-29, an alternate embodiment of dish segment 270 is illustrated adding magnets 284 and 288 in combination with detents 290 and 292. FIGS. 27-29 illustrate alternate positions for 284 and 288 with respect to detents 290 and 292. In a first embodiment, magnet 288*a* is located proximate to male detent 290 and magnet 284*a* is located proximate to female detent 292. In a second embodiment, magnet 288*b* is located away from male detent 290 on sidewall 272 and magnet 284*b* is located away from female detent 292 on sidewall 274. In either embodiment, magnets 284 and 288 and detents 290 and 292 cooperate to affix dish segments 270 together as a parabolic dish, as explained in greater detail hereinabove. Of course, both the 284*a*/288*a* and 284*b*/288*b* magnet sets may be used on the same segment 270. In any of these embodiments, the magnets help to align and hold the segments 270 together, while the detents 290/292 help to resist shear forces that may move the magnet pairs out of alignment.

While not illustrated in FIGS. 24-29, the configurations of magnets 182, 184, 186 and 188 and the components to assemble the parabolic dish with transceiver 40 described above with respect to FIGS. 1-23 can be used in conjunction with the embodiments described in FIGS. 24-29.

While this disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed:

1. An antenna, comprising:

a plurality of dish segments each having a first sidewall and a second sidewall, wherein placing said plurality of dish segments in a side-by-side arrangement forms an antenna reflector; and a transceiver assembly including a retainer that clamps a first sidewall of each dish segment to a second sidewall of an adjacent dish segment to hold said plurality of dish segments in said side-by-side arrangement, wherein said transceiver assembly comprises:

a transceiver having a first threaded surface; and a nut having a second threaded surface;

wherein said first and second threaded surfaces are threadingly engaged such that said plurality of dish segments and said retainer are positioned between said nut and said transceiver;

wherein each of said plurality of dish segments comprises:

an end wall; and a mounting portion;

wherein said retainer comprises a plurality of notches; and wherein each notch accepts said first sidewall of a first one of said plurality of dish segments and said second sidewall of a second one of said plurality of dish segments.

2. The antenna of claim 1, wherein said mounting portion and said endwall of each of said plurality of dish segments are positioned between said nut and said transceiver.

3. An antenna, comprising:

a plurality of dish segments, each of said plurality of dish segments comprising:

a first endwall;

a second endwall;

at least one first magnet disposed on said first endwall; and at least one second magnet disposed on said second endwall;

wherein placing said plurality of dish segments in a side-by-side arrangement forms an antenna reflector, such that each one of said plurality of first magnets is positioned adjacent a respective one of said plurality of second magnets, thereby forming a plurality of magnet pairs; and wherein attraction between each first magnet and second magnet pair is operative to hold said plurality of dish segments in said side-by-side arrangement;

a transceiver having a first threaded surface;

a retainer; and a nut having a second threaded surface;

wherein said first and second threaded surfaces are threadingly engaged such that said plurality of dish segments and said retainer are positioned between said nut and said transceiver;

wherein each of said plurality of first magnets is disposed on a respective one of said plurality of first sidewalls using an adhesive; and wherein each of said plurality of second magnets is disposed on a respective one of said plurality of second sidewalls using said adhesive.

4. The antenna of claim 3, wherein:

each of said plurality of dish segments comprises:

an end wall; and a mounting portion;

said retainer comprises a plurality of notches; and each notch accepts said first sidewall of a first one of said plurality of dish segments and said second sidewall of a second one of said plurality of dish segments.

5. The antenna of claim 4, wherein said mounting portion and said endwall of each of said plurality of dish segments are positioned between said nut and said transceiver.

6. An antenna, comprising:

a plurality of dish segments, each of said plurality of dish segments comprising:

a first endwall;

a second endwall;

at least one first detent disposed on said first endwall; and at least one second detent disposed on said second endwall;

wherein placing said plurality of dish segments in a side-by-side arrangement forms an antenna reflector, such that each one of said plurality of first detents is positioned adjacent a respective one of said plurality of second detents, thereby forming a plurality of detent pairs; and wherein interaction between each first detent and second detent pair is operative to resist shear forces between said plurality of dish segments; and a transceiver assembly including a retainer that clamps a first sidewall of each dish segment to a second sidewall of an adjacent dish segment to hold said plurality of dish segments in said side-by-side arrangement;

the transceiver having a first threaded surface; and a nut having a second threaded surface;

wherein said first and second threaded surfaces are threadingly engaged such that said plurality of dish segments and said retainer are positioned between said nut and said transceiver.

7. The antenna of claim 6, wherein:

each of said plurality of dish segments comprises:

an end wall; and a mounting portion;

said retainer comprises a plurality of notches; and each notch accepts said first sidewall of a first one of said plurality of dish segments and said second sidewall of a second one of said plurality of dish segments.

8. The antenna of claim 7, wherein said mounting portion and said endwall of each of said plurality of dish segments are positioned between said nut and said transceiver.

9. An antenna, comprising:

a plurality of dish segments, each of said plurality of dish segments comprising:

a first endwall;

a second endwall;

at least one first magnet disposed on said first endwall;

at least one second magnet disposed on said second endwall;

at least one first detent disposed on said first endwall; and at least one second detent disposed on said second endwall;

wherein placing said plurality of dish segments in a side-by-side arrangement forms an antenna reflector, such that:

each one of said plurality of first detents is positioned adjacent a respective one of said plurality of second detents, thereby forming a plurality of detent pairs; and each one of said plurality of first magnets is positioned adjacent a respective one of said plurality of second magnets, thereby forming a plurality of magnet pairs; and wherein attraction between each first magnet and second magnet pair is operative to hold said plurality of dish segments in said side-by-side arrangement; and wherein interaction between each first detent and second detent pair is operative to resist shear forces between said plurality of dish segments.

10. The antenna of claim 9, wherein:

each of said plurality of first magnets is integrally formed with a respective one of said plurality of first sidewalls; and each of said plurality of second magnets is integrally formed with a respective one of said plurality of second sidewalls.

11. The antenna of claim 9, wherein:

each of said plurality of first magnets is disposed on a respective one of said plurality of first sidewalls using an adhesive; and each of said plurality of second magnets is disposed on a respective one of said plurality of second sidewalls using said adhesive.

12. The antenna of claim 9, wherein said first detent comprises a male detent and said second detent comprises a female detent.

13. The antenna of claim 9, wherein:

each of said plurality of first magnets is positioned proximate to a respective one of said plurality of first detents; and each of said plurality of second magnets is positioned proximate to a respective one of said plurality of second detents.

14. The antenna of claim 9, further comprising:

a transceiver having a first threaded surface;

a retainer; and a nut having a second threaded surface;

wherein said first and second threaded surfaces are threadingly engaged such that said plurality of dish segments and said retainer are positioned between said nut and said transceiver.

15. The antenna of claim 14, wherein:

each of said plurality of dish segments comprises:

an end wall; and a mounting portion;

said retainer comprises a plurality of notches; and each notch accepts said first sidewall of a first one of said plurality of dish segments and said second sidewall of a second one of said plurality of dish segments.

16. The antenna of claim 15, wherein said mounting portion and said endwall of each of said plurality of dish segments are positioned between said nut and said transceiver.

* * * * *